United States Patent [19]

Hartmann

[11] Patent Number: 4,893,371

[45] Date of Patent: Jan. 16, 1990

[54] SCOURING PAD

[76] Inventor: Hans J. Hartmann, P.O. Box 2026, Woonsocket, R.I. 02895

[21] Appl. No.: 223,405

[22] Filed: Jul. 25, 1988

[51] Int. Cl.[4] ..... A47L 13/07

[52] U.S. Cl. ..... 15/209 B; 15/118; 15/244.3; 29/433

[58] Field of Search ..... 15/118, 244.3, 105, 15/209 B; 29/433; 300/19, 21

[56] References Cited

U.S. PATENT DOCUMENTS 2,427,274 9/1947 Goodloe ..... 15/209 B
2,500,715 3/1950 Steiner ..... 15/209 B
2,948,911 8/1960 Steiner ..... 15/209 B

FOREIGN PATENT DOCUMENTS 950702 2/1964 United Kingdom ..... 15/209 B

*Primary Examiner*—Chris K. Moore
*Attorney, Agent, or Firm*—Barlow & Barlow, Ltd.

[57] ABSTRACT

A scouring pad has a toroidal core that is covered with a double layer of mesh material. The mesh is tubular in form and is formed by passing the same up through the central opening in the core of sponge-like material so that the ends of the tubular mesh may be folded over the core and tucked in the center to interlock.

3 Claims, 1 Drawing Sheet

SCOURING PAD

BACKGROUND OF THE INVENTION

Cleaning articles which are adapted for washing and scrubbing and polishing, particularly metallic articles, have been heretofore known in the art. There have been any number of scouring pads that have been made from knitted metallic ribbon-like wire and patents such as Benjamin, et al, U.S. Pat No. 3,241,171 and Kingman, U.S. Pat. No. 2,152,697 are but two examples of an extensive field. Some of the scouring pads include a detergent within the scouring pad and in many cases, the scouring pad is made in such a way that it does not float and will drop to the bottom of the sink in which the pots and the like are being cleansed.

It is an object, therefore, of the present invention to provide a novel scouring pad which embodies a core which has a number of closed cells so that the entire pad will float. Another object of the invention is to provide a novel scouring pad which has a cover member that is connected to the core in a novel and expeditious manner.

SUMMARY OF THE INVENTION

The present invention of a scouring pad embodies a core member which may be sponge-like with a plurality of closed cells and about which is a double layer of a knitted ribbon-wire mesh. The core is preferably a toroid of sponge-like material and the cover is preferably a tubular mesh which is passed through the center aperture of the toroid and then one end of the mesh is folded over the toroid after which the second end of the toroid is folded over the first and thence passed back through the center opening; thus, fastening all of the parts together in a neat package with the mesh interlocking to itself.

DESCRIPTION OF THE PREFERRED EMBODIMENT

Figure 1:
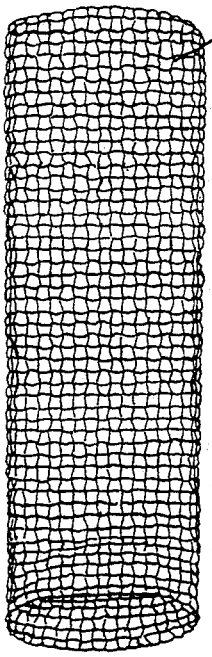
FIG. 1 is the perspective view of the tubular mesh that is part of the invention.
Figure 2:
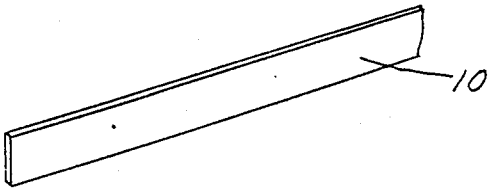
FIG. 2 is a greatly enlarged view of the metallic wire that forms the mesh.
Figure 3:
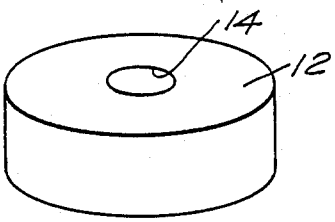
FIG. 3 shows the toroid cut from a sponge material.
Figure 4:
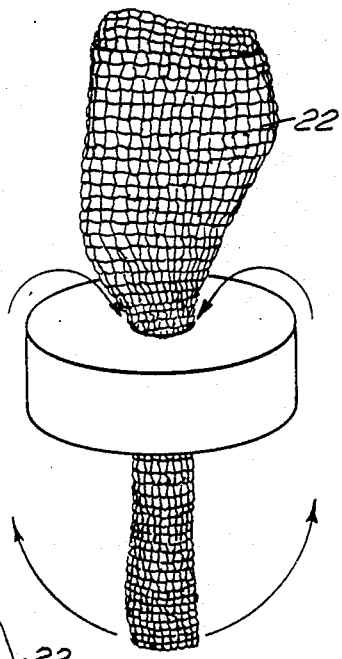
FIG. 4 shows the first step in manufacturing the scouring pad by passing the tubular mesh through the center opening.
Figure 5:
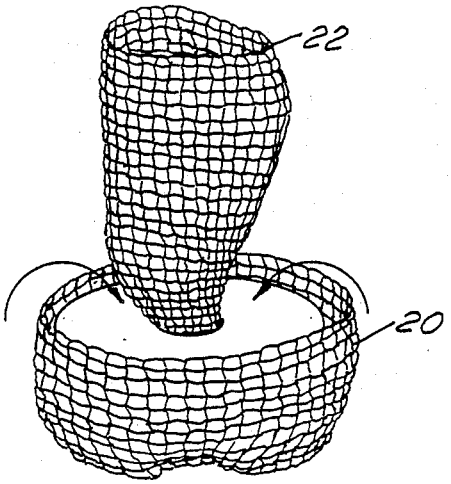
FIG. 5 shows the next step in which the first end of the tubular mesh is passed over the toroid body.
Figure 6:
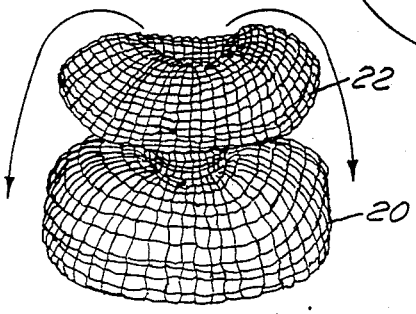
FIG. 6 shows the next step wherein the other end is passed over the toroid body.
Figure 7:
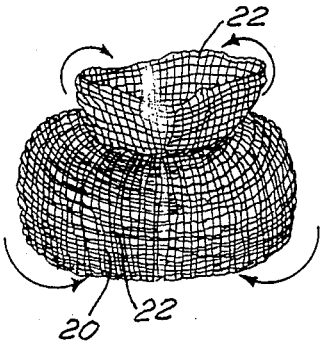
FIG. 7 shows the article where the other end is passed up through the center hole.
Figure 8:
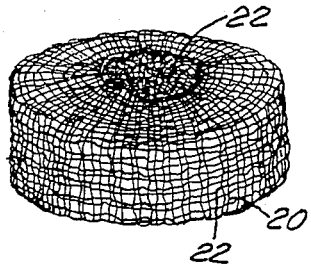
FIG. 8 illustrates the completed article.

The scouring pad is formed of a closed-cell, foam-like material 10 which is cut into a toroidal form 12 as seen in FIG. 3 with a central aperture 14. The cover of the scouring pad is formed of an open mesh material such as a netting having strands of ribbon-metallic wire formed into a tubular core 16. The mesh is essentially made from flexible metallic ribbon material as seen in FIG. 2 and may be of a thickness of approximately 0.002"and a width of six times or on an order of 0.12". The weave or knit form of the mesh affords a plurality of scraping edges and is the preferred form. The tubular mesh material is first stretched in the central longitudinal portion thereof more or less into an hour glass shape and then by passing the tubular mesh material through the center 14 of the toroid as seen in FIG. 4. Referring now to FIG. 5, one end of the tubular mesh is now folded back over the toroidal part 12 so that the ends 20 lie eventually adjacent to the opening 14. The other end 22, as seen in FIG. 6, is now passed over the body of the toroid and down onto the other side, there being sufficient length provided so that the end 22 can be tucked up into the aperture 14 to come out the other end as seen in Fig. 7. At this point, the loose ends can be tucked back into the aperture so as to form a neat and completed article.

In its completed form, it will be apparent that there is a double layer of metallic mesh that overlies the toroidal core 12 which, as heretofore mentioned, is made of a closed cell sponge-like material such as a polyurethane.

In use, the user grasps the scouring pad in any convenient way and the resilience of the sponge-like interior material permits the mesh exterior to work into convex portions of pots and to be placed in various other positions depending upon the article being cleansed. It should be understood that the mesh material 16, while initially being disclosed as made of a knitted ribbon-like metallic material could be made of other material that afforded an abrasive action as, for example, nylon ribbon and, of course, the sponge material 12 can be made from other groups of cellular material such as cellulose acetate.

With the cleaning article constructed in the manner described above, it will be appreciated that the article affords a single, highly practical cleaning article which may be used for washing, scraping, scrubbing and polishing as the article may be disposed in various positions to reach crevices and the like.

I claim:

1. A scouring pad comprising a porous, resilient toroidal core having a central opening, a tubular knitted metallic ribbon mesh located in the central opening with its ends folded back over the core to form two plies over the core and with the last folded and tucked into the opening at the opposite side of the core.

2. The method of forming a scouring pad comprising the steps of:

(a) cutting a toroidal part from a sheet of sponge material;

(b) forming ribbon mesh into a tube;

(c) passing the tubular mesh through the center of the toroidal sponge;

(d) folding back over the toroidal part one end of the mesh;

(e) folding back over the toroidal part the other end of the mesh and passing this end through the center of the toroidal part.

3. The method of forming a scouring pad as in claim 2 wherein after step (b), the following step is performed:

($b_1$) stretching the mesh by pulling the ends and forming the tube into an hour glass shape.

* * * * *